United States Patent [19]

Hesselmar

[11] Patent Number: 4,715,755

[45] Date of Patent: Dec. 29, 1987

[54] SECURING DEVICE FOR SECURING IN CAVITIES

[75] Inventor: Karl G. Hesselmar, Lerum, Sweden

[73] Assignee: AB Holmgrens Armaturfabrik, Gnosjö , Sweden

[21] Appl. No.: 852,457

[22] PCT Filed: Jul. 15, 1985

[86] PCT No.: PCT/SE85/00280

§ 371 Date: Mar. 18, 1986

§ 102(e) Date: Mar. 18, 1986

[87] PCT Pub. No.: WO86/00964

PCT Pub. Date: Feb. 13, 1986

[30] Foreign Application Priority Data

Jul. 18, 1984 [SE] Sweden ..... 8403763

[51] Int. Cl.[4] ..... F16B 13/04; E21B 23/00

[52] U.S. Cl. ..... 411/39; 411/50; 411/80; 411/913; 166/215

[58] Field of Search ..... 411/21, 22, 39, 40, 411/49, 50, 51, 55, 60, 66, 80; 166/136, 137, 214, 215, 317; 220/233, 234

[56] References Cited

U.S. PATENT DOCUMENTS 3,078,862 2/1963 Maly ..... 166/317

3,158,059 11/1964 Myers ..... 411/49

3,556,216 1/1971 Condra ..... 166/215

*Primary Examiner*—Gary L. Smith

*Assistant Examiner*—Neill Wilson

[57] ABSTRACT

A securing device for securing in cavaties and comprising a number of clamping jaws (11), provided under influence of a changeable tension body (21) to expand against opposite wall portions (13) in said cavity. The clamping jaws (11) have engagement surfaces (12) which are forced outwards and tension surfaces provided to cooperate with a tension surface (22) of the tension body. By means of a displacement motion of the clamping jaws relative to the tension body is brought to adjust the clamping jaws between an inner releasing position, and an outer expanded securing position. The device comprises a spring mechanism (4) provided to press the clamping jaws (11) in direction against the tension body (21). Between the clamping jaws and the tension body a distance element (20) is positioned being provided to maintain in its releasing position a predetermined distance between a support surface (19) of each clamping jaw and a surface (23) of said distance element. The distance element is made of a material changeable by means of the environmental influence as to shape, so that after a certain time interval said distance will be considerably reduced, resulting in said displacement motion of the clamping jaws relative to the tension body so that the expanded securing position will be automatically taken with a time delay, counted from the time when said environment influence is initiated.

6 Claims, 6 Drawing Figures

SECURING DEVICE FOR SECURING IN CAVITIES

TECHNICAL FIELD

The present invention relates to a securing device for securing in cavities and comprising a number of clamping jaws provided under influence of a changeable tension body to expand against opposite wallportions in said cavity, said clamping jaws having engagement surfaces which are forced outwards and tension surfaces, provided to cooperate with a tension surface of the tension body which by means of a displacement motion of the clamping jaws relative to the tension body is brought to adjust the clamping jaws between an inner, releasing position and an outer, expanded securing position.

TECHNICAL PROBLEM

It is prior known with different embodiments of securing devices of the type expanding devices for the purpose of securing objects. For certain objects difficulties can arise to adjust the expanding devices to expanded position because of poor acessability, for example when a device is to be secured in a cavity under ground level, for example in a longitudinal bore, a tube or similar. Especially securing pumping devices in bore cavities or pump tubes has been a great problem because of the poor accessability to the securing place.

THE SOLUTION

The object of the present invention is to eliminate the above described difficulty by means of a securing device which is characterized by said device comprising a spring mechanism, provided to press the clamping jaws in direction against the tension body, and a distance element, positioned between the clamping jaws and the tension body, said distance element being provided to maintain in its releasing position a predetermined distance between a support surface of each clamping jaw and a surface of said distance element, which is made of a material changeable by means of the environmental influence as to shape, so that after a certain time interval said distance will be considerably reduced, resulting in said displacement motion of the clamping jaws relative to the tension body, so that the expanded securing position will be automatically taken with a time delay, counted from the time, when said environment influence is initiated.

BRIEF DESCRIPTION OF DRAWINGS

The present invention will in the following be further described in an embodiment with reference to the accompanying drawings on which

PREFERRED EMBODIMENT

Figure 1:
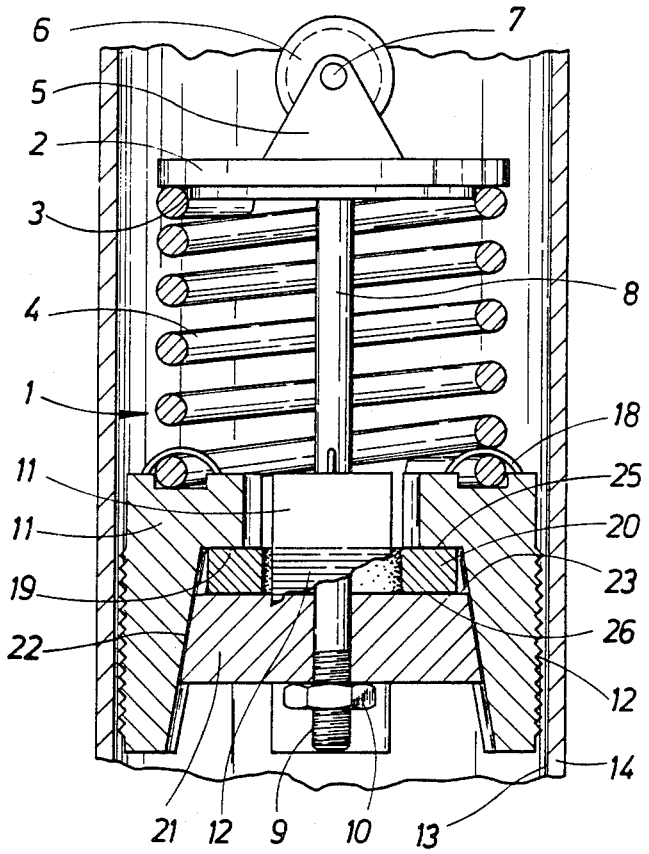
FIG. 1 shows a partly broken sectional view through the securing device according to the invention in a releasing position.
Figure 2:
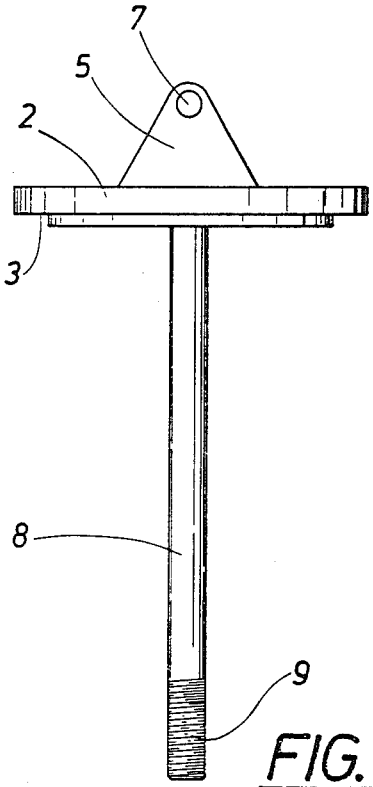
FIGS. 2, 3 and 4 show different parts included into the securing device.
Figure 3:
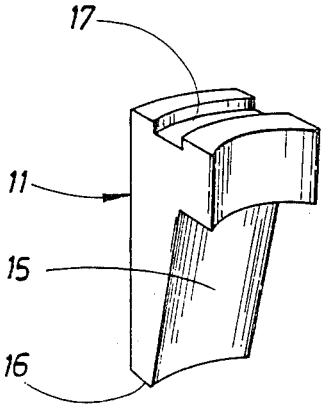
Figure 4:
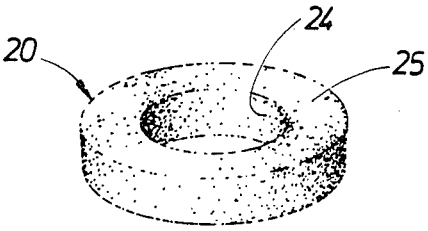

The securing device 1 according to the present invention is of an expandable type and comprises a support plate 2, which is suitably circular and has a peripherical step 3 which forms the seat for a powerful pressure spring 4. At the support plate a bracket 5 for a wire wheel 6 is connected which by means of a shaft 7 is pivotally journalled in the bracket. A rod or shaft 8 is secured to the support plate 2, said shaft being directed downwards from said plate and extending centrally and being provided at its bottom end with a threaded portion 9 on which a tension nut 10 is screwed. The support plate 2 and the shaft 8 are shown separately in FIG. 2. The securing device consists further of a number, in the shown example four clamping jaws 11, the embodiment of which also is apparent from FIG. 3. The clamping jaws have a wedge shaped cross section with an outwardly faced engagement surface 12 for engagement against the surface 13, against which the securing device is to be secured. This surface 13 is in the shown example the cylindric inner surface of a cylindric tube 14, for example a bore tube for lining a bore hole for the purpose for example the supply of water. Therefore the engagement surface 12 is substantially designed cylindrically, but extends over merely a part of the periphery of the cylinder, at the most a fourth of the periphery in the case with four clamping jaws 11. In the shown example the width is some centimeter or centimeters which is apparent from the end view of one of the clamping jaws 11 which is shown in a broken view. From FIG. 1 it is apparent that the engagement surface 12 is fluted in order to improve the securing properties. FIG. 1 is for example shown in a scale of the size of 1:1–1:2. The clamping jaws 1 have an inwardly faced tension surface 15 with a conical shape so that the distance of the tension surface to the engagement surface 12 decreases in direction against the bottom end 16 of the clamping jaws 11. At the top the clamping jaws 11 have a circularly arched groove 17 which forms the bottom seat for the tension spring 4. A clamp 18 in each clamping jaw 11 secures a positioning of the spring in the groove. The clamping jaws 11 are however allowed to be displaced sidewardly relative to the spring. The clamping jaws 11 have a downwardly faced support surface 19, by means of which the clamping jaws rest against a distance plate 20, which also is shown in FIG. 4 and the properties of which closer will be described below. The distance plate 20 is supported by a tension body 21 in the shape of a tension cone which has the form of a frustrum of a correctly turned cone which has a conical tension surface 22 which is provided to cooperate with conical tension surfaces 15 of the clamping jaws 11. The tension cone 21 has a central bore through which the shaft 8 extends. The tension cone is continuously kept pressed in its position by means of the tension spring 4 over the intermediate clamping jaws 11 and the distance plate 20 which position is determined by the position of turning of the tension nut 10. By turning the tension nut 10 the tension cone 21 can thus be displaced in height along the shaft 8 resulting in that the clamping jaws 11 are positioned in different side displacement positions which gives the securing device different outer diameters, ie diametrical distances between the engagement surfaces 12.

Figure 5:
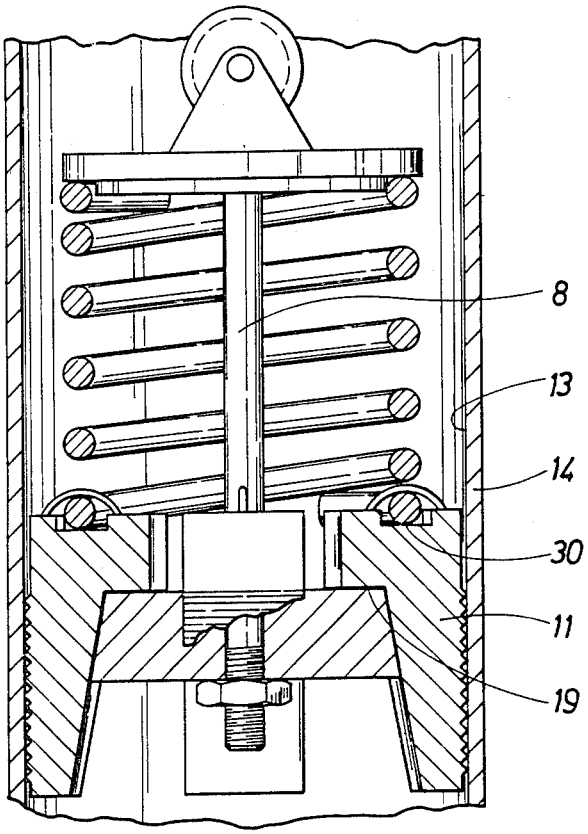
FIG. 5 shows the securing device in an expanded securing position and FIG. 6 shows a way of using where the securing device secures a pumping device in a bore hole.

In accordance with the present invention the securing device is provided to automatically be changed from its releasing position shown in FIG. 1 in which the securing device can be allowed to be displaced along the bore hole in the tube 14, to its clamping position shown in FIG. 5 in which the clamping jaws 11 are pressed radially outwards against the surface 13 of the tube 14. This has in accordance with the present invention been accomplished by that the distance plate 20 is made in a material which can be dissolved, melted or broken down by enviromental influence, whereby the shape of the distance plate will be changed and its distance maintaining effect, that is to say maintenance of the distance between the upper side 23 of the tension cone 21 and the support surface 19 of the clamping jaws 11, will be reduced by the time. An example of such a material is saltstone, a nature of rock from which the distance plate 20 according to FIG. 4 can be shaped as a toroid by working a solid piece resulting in the shape as shown with a central through hole 24, through which the shaft 8 can extend, and with a predetermined height, that is to say distance between the plane upper side 25 of the distance plate 20 and plane bottom side 26. Alternatively the saltstone can be shaped by pulverized saltstone material, pressed under pressure to the desired shape and bound by means of a binding agent having properties, similar to the properties of the saltstone. The properties of the saltstone are such that the stone is dissolved by water and by humidity in the air after a delay of time, which is determined by different kinds of saltstone and humidity in the present enviroment. Before the securing device is positioned the whole securing device or at least distance plate 20 is kept encased, for example positioned in plastic bag which can be provided with a substance which absorbs moisture so that the dissolving and breaking down process will not be started before the securing device is kept in place in connection with which measure the encapsulation will be removed. If the securing device will not be placed in a humidified environment or water, the securing device can before it is positioned be placed in a plastic bag filled with water which starts the process of dissolution and break down. The time from the start of the process until the distance plate is so dissolved that the securing device takes its securing position can vary from approximately an hour to one day and night which consequently can be determined with respect to the actual use. Further distance plates 20 of different height can be chosen, that is to say different distance between their upper side 25 and their bottom side 26 which results in a differently large expansion motion. The expansion is determined also by the inclined angle of the conical surfaces 15, 22.

As long as the distance plate 20 is not influenced the securing device maintains its releasing position shown in FIG. 1. In this condition the securing device can be inserted and positioned at that location where it is to be secured, in the shown example in the tube 14. The hole can for example be filled with water, resulting in that the dissolution process will be initiated resulting in that the distance plate 20 gradually diminishes in hight and finally will be completely disolved. During this process the clamping jaws 11 will by means of the tension spring 4 be pressed in direction downwards having a component force directed in the direction of the shaft 8. In the initial position it is arranged that the clamping jaws 11 are positioned in a radially inner position, that is to say having the engagement surfaces 12 on its shortest distance from each other so that the tension surfaces 15 of the clamping jaws are in contact with the tension surface 22 of the tension cone 21. During the motion of the clamping jaws in the direction downwards they slide with their tension surfaces 15 against the tension surface 22 of the tension cone 21, resulting in that a relative to the shaft 8 radially outwards acting component force is directed against the clamping jaws 11, said component pressing the clamping jaws 11 in the direction outwards. The groove 17 for the tension spring 14 is dimensioned with such play that the spring will not prevent this motion. This results in that under influence from the tension spring 4 and the tension cone 21 the clamping jaws will be pressed in direction radially outwards against the internal surface 13 of the tube 14, resulting in that the securing device will be brougt in a secure engagement with the surface 13. By connection to the securing device of the present object which is to be secured, consequently the desired securing function will be obtained.

Figure 6:
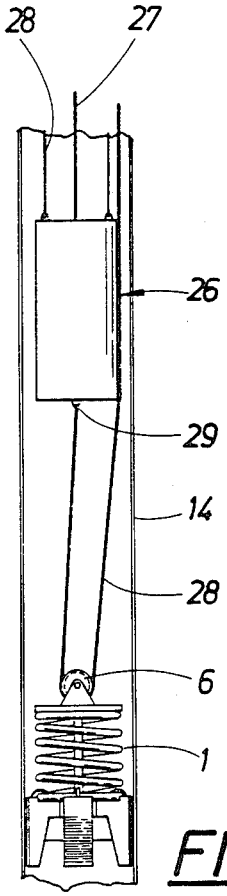

In FIG. 6 an example is shown of securing a pumping device 26 in a bore hole which can be a hole bored in rocks or a hole lined with a bore tube 14. The pumping device requires an anchoring in the bore hole in order not to follow the arising pumping motions. In the shown example the pumping device is a piston pump with a piston reciprocating in a cylinder, which is driven by means of a piston rod 27 which is operated from a position above the ground level, for example by means of a lever arm which is operated manually. Alternatively the motion can be obtained by means of a drive motor with for example an excentric connection of the piston rod 27 in its upper end. The pumping device is in this case for example kept hanging in two wires 28, which in their upper ends are attached to a place at the upper end of the bore hole. However it is important for purpose of services to be able to raise the pumping device 26 from the bore hole. Therefor the pumping device is releasably secured to the securing device 1 by means of an anchoring wire 28 which is connected to the pumping device in one of its ends 29 and is re-linked in the wire wheel 6 and extends upwards through the pumping hole past the pumping device and is in its opposite end connected at the upper end of the pumphole. At this connection the wire is preferably of such a length that, when the pumping device will be lifted the connection will be released and the wire will be fed downwards so that the pumping device simultaneously can be lifted to a location above ground level without loosing the control over the wire-end attached at the upper end of the bore hole. When sinking down the pumping device the wire 28 is to be drawn upwards so that it again can be tensioned and attached in order to secure the pumping device to the securing device, which by means of expanding action is secured against the wall of the pump hole in the above described manner. By the fact that the support plate 2 and consequently the shaft 8 are provided to receive loads, a traction force in the wire 28 will result in a raised radial component force because of the tendency of the tension cone 21 to be raised.

The securing device 1 can be manufactured in different materials. The support plate 2, the shaft 8, the bracket 5 and the tension spring 4 and the tension nut 10 are preferably made in a corrosion resistant metal. The wire-wheel 6, the tension jaws 11 and the tension cone 21 can also be made of metal, but can also be made in a strong plastic material, for example delrine. The clamps 28 are preferably made in metal wire and the shaft 7 of the wire-wheel 6 preferably is made in steel. Further it will be pointed out that the spring 4 preferably is made with such diameter that its contact against the clamping jaws, that is to say along a circular line 30, is positioned radially outwards the support surface 19, involving that the clamping jaws by means of the spring force tend to secure a good contact in the tension surfaces 15, 22.

The present invention is not limited to the embodiment proven and described above, but can be modified in a plurality of ways within the scope of the accompanying claims. For example the securing device can have another connecting device for the object which is to be connected other than the wire-wheel 6 and the wire 28 as shown. For example the wire-wheel 6 can be replaced by a loop, threaded shaft or similar. In certain cases the securing device can be permanently connected to the object which is to be secured and in this case the support plate 2 is connected to or forms a part of the object in question. The tension screw 10 can be replaced by a fixed head, whereas the shaft extends through the tension plate and is provided with a tension nut on the upper side of the plate so that the height of the tension cone 21 can be adjusted by displacement of the shaft 8 as a whole. For connection in cavities with a different cross-section the securing device can be shaped for adaption thereafter, for example in cavities with a square or rectangular cross section, in which case the clamping jaws are made with straight engagement surfaces. The distance plate 20 can be made in a different material which in a high degree will be changed in form or dissolved by means of enviromental influence with a certain time delay. For example the material can be dissolveable in oxygen and in this case be incapcylated up to the mounting occasion.

I claim:

1. A securing device for use in a cavity, comprising: a plurality of clamping jaws, a changeable tension body adapted to expand said clamping jaws against opposite wall portions in said cavity, said clamping jaws having engagement surfaces to be forced outwardly, and also having tension surfaces for cooperation with a tension surface of the tension body which by a displacement motion of the clamping jaws relative to the tension body is brought to adjust the clamping jaws between an inner, releasing position and an outer, expanded securing position, a spring mechanism for pressing the clamping jaws against the tension body, and a distance element positioned between the clamping jaws and the tension body, said distance element maintaining in said releasing position a predetermined distance between support surfaces of the clamping jaws and a surface of said distance element, said distance element being made of a material soluble in water such that the material is contacted with a source of water and after a certain time interval the distance element is disolved and said distance will be reduced, so as to result in said displacement motion of the clamping jaws relative to the tension body, whereby the expanded securing position will be automatically taken with a time delay from the time, when said enviromental influence begins.

2. A device according to claim 1, wherein said distance element consists of salt stone.

3. A device according to claim 1, wherein the tension body has a conical tension surface and is positioned on a shaft which forms a symmetrical axis for the tension surface, said surface of the distance element extending transversely to said axis, and said spring mechanism directing a tension force against the clamping jaws substantially in the direction of said axis, whereby said relative displacement motion causes the clamping jaws to move radially outwardly.

4. A device according to claim 3, wherein the tension body is adjustable between different positions along said shaft.

5. A device according to claim 1, wherein a connecting device is connected to said shaft for connecting an object to the securing device.

6. A device according to claim 5 wherein said connecting device is attached to a support plate to which the shaft is connected, and wherein said spring mechanism is a pressure spring biased between the support plate and the clamping jaws.

* * * * *